US009957137B2

(12) United States Patent
Soljamo et al.

(10) Patent No.: US 9,957,137 B2
(45) Date of Patent: May 1, 2018

(54) ELEVATOR CAR

(71) Applicants: Kari Soljamo, Helsinki (FI); Matti Räsänen, Hyvinkaa (FI); Mika Alvesalo, Espoo (FI); Mikael Alanen, Espoo (FI)

(72) Inventors: Kari Soljamo, Helsinki (FI); Matti Räsänen, Hyvinkaa (FI); Mika Alvesalo, Espoo (FI); Mikael Alanen, Espoo (FI)

(73) Assignee: Kone Corporation, Helsinki (FI)

( * ) Notice: Subject to any disclaimer, the term of this patent is extended or adjusted under 35 U.S.C. 154(b) by 430 days.

(21) Appl. No.: 14/193,951

(22) Filed: Feb. 28, 2014

(65) Prior Publication Data

US 2014/0284147 A1 Sep. 25, 2014

(30) Foreign Application Priority Data

Mar. 20, 2013 (EP) ..... 13160111

(51) Int. Cl.
*B66B 11/02* (2006.01)

(52) U.S. Cl.
CPC ..... *B66B 11/0226* (2013.01)

(58) Field of Classification Search
CPC .... B66B 11/0226; B27K 3/00; B27K 2240/30
USPC ..... 187/401; 428/920, 541
See application file for complete search history.

(56) References Cited

U.S. PATENT DOCUMENTS 3,671,376 A * 6/1972 Okazaki et al. ..... B32B 21/04 156/335
3,950,577 A * 4/1976 Fry ..... B27K 3/0285 144/246.1
4,361,613 A * 11/1982 Bogner ..... B32B 5/18 156/212
4,567,087 A * 1/1986 O'Dell ..... B32B 29/00 156/222

(Continued)

FOREIGN PATENT DOCUMENTS

CN 1414904 A 4/2003
CN 102099186 A 6/2011

OTHER PUBLICATIONS

"Arborite Fire Rated Laminate" HPL Technical Information, Arborite. Jan. 31, 2013. (http://www.arborite.com/us/HPL-Technical-Information).

(Continued)

*Primary Examiner* — William E Dondero
*Assistant Examiner* — Diem M Tran
(74) *Attorney, Agent, or Firm* — Harness, Dickey & Pierce, P.L.C.

(57) ABSTRACT

The elevator car includes a floor, a ceiling, and side walls connecting the floor and the ceiling. At least the inner surface of at least some of the side walls of the elevator car may be covered with sheets of board. The board includes a fire retardant plywood having a front surface and an opposite back surface. The front surface of the fire retardant plywood may be coated with a first material layer including a fire retardant laminate. The fire retardant laminate may be attached with heat resistant or fire retardant glue to the fire retardant plywood. The back surface of the fire retardant plywood may be coated with a second material layer having a same thickness and a same material properties as the laminate.

13 Claims, 3 Drawing Sheets

(56) References Cited

U.S. PATENT DOCUMENTS

| | | | | |
|---|---|---|---|---|
| 4,635,756 | A * | 1/1987 | Sherwood | B66B 11/0253 187/401 |
| 4,657,789 | A * | 4/1987 | Lars | B27D 1/086 427/211 |
| 2001/0030011 | A1* | 10/2001 | Nasli-Bakir | B27G 11/00 156/64 |
| 2006/0070321 | A1* | 4/2006 | Au | C04B 28/26 52/232 |
| 2010/0015420 | A1* | 1/2010 | Riebel | B32B 27/06 428/203 |
| 2010/0075095 | A1* | 3/2010 | Johnson | B27N 1/00 428/53 |
| 2012/0031712 | A1* | 2/2012 | Bloch | B66B 5/024 187/401 |
| 2014/0305748 | A1* | 10/2014 | Kere | B66B 11/0206 187/401 |

OTHER PUBLICATIONS

"Laminating Principals" HPL Technical Information, Arborite. Jan. 15, 2003. (http://www.arborite.com/us/HPL-Technical-Information).

"Substrates" HPL Technical Information, Arborite. Jan. 15, 2003. (http://www.arborite.com/us/HPL-Technical-Information).

"Adhesive Selector" HPL Technical Information, Arborite. Jan. 15, 2003. (http://www.arborite.com/us/HPL-Technical-Information).

"High Pressure Laminate: Arborite Fire Retadant Laminate", Royal Plywood Company. Feb. 3, 2011. (http://web.archive.org/web/20110203225037/http://www.royalplywood.com/Architects/AR-FireRetardant.html).

European Search Report for EP13160111 dated Aug. 28, 2013.

Written Opinion for EP13160111 dated Aug. 28, 2013.

* cited by examiner

ELEVATOR CAR

This application claims priority pursuant to 35 U.S.C. § 119 to European Patent Application No. EP13160111 which has an International filing date of Mar. 20, 2013, the entire contents of which are incorporated herein by reference.

TECHNICAL FIELD

An elevator comprises an elevator car, an elevator shaft, a machine room, lifting machinery, ropes, and a counter weight. The lifting machinery moves the elevator car in a first direction upwards and downwards in the vertically extending elevator shaft. The elevator car comprises a floor, a ceiling and side walls connecting the floor and the ceiling. The elevator car is carried by the ropes, which connect the car to the counter weight. The car is supported and guided with suitable means when moving upwards and downwards in the elevator shaft. The car can be stopped at each landing in order for people and/or goods to enter and/or leave the car.

The interior surfaces of the side walls of the elevator car might be coated with some kind of sheets of board.

BACKGROUND

Plywood has been used on the interior wall surfaces of the elevator car for a long time. Plywood is cost efficient and endures wear which makes it a suitable material to be used on the interior wall surfaces of an elevator car.

The appearance of plywood is, however, not very appealing restricting the use of plywood as such in modern elevator cars. The appearance of plywood can be improved by painting or by coating plywood with some other material having a more appealing appearance.

The requirements for flame retardation of building materials are also constantly increasing. Plywood is a flammable material and this fact might cause restrictions in the use of plywood in elevator cars. It is, however, possible to treat plywood so that the fire characteristics of plywood are improved. It is possible to impregnate the plywood with fire retardant solutions and to use suitable glues to attach the veneers in the plywood in order to improve the fire characteristics of plywood. Some manufactures provide commercial plywood which has improved fire characteristics. It is naturally easier to achieve better fire characteristics with thick plywood compared to thin plywood.

A coating on the plywood might on the other hand degrade the fire characteristics of the plywood. This is due to the fact that flashover might occur in the coating during fire testing which will degrade the fire characteristics of the plywood. Also the attachment of the coating to the plywood might cause problems in fire testing. The attachment must withstand heat developed during fire to a certain degree.

The fire classes of building material are defined in European stand-and EN 13501-1. The standard defines seven main fire classes i.e. A1, A2, B, C, D, E and F. The additional classes relating to the smoke production properties of the product are s1, s2, s3. The additional classes relating to the formation of flaming droplets or parts of the product are dO, dI, d2. European standard EN 13501-1 also defines the test methods to be used in the different fire classes. A product to be classified in the fire class B must be tested with the SBI-test (Single Burning Item test) in a small room according to European standard EN 13823 and with the inflammability test with a small flame according to European standard EN ISO 11925-2. The results of these tests determine whether the product can be rated in fire class B or not.

An internet site Arborite: "HPL Technical Information", 31 Jan. 2013, XP05076678, Retrieved from the Internet: URL: http://www.arborite.com/us/HPL-Tehcnical-Information comprises a technical guide relating to high pressure laminates (HPL) provided by the company Ar-borite. The section "Arborite fire rated laminates" describes different properties of the Arborite fire rated laminates. The section "Arborite fire rated laminates" states that Arborite high pressure laminate with fire rated properties are suitable for applications where fire retardant properties are required by building codes i.e. elevator cars, stairwalls, public areas, and hospitals. The section "Substrates" states that good quality particleboard and medium or high density fiberboards are satisfactory for use as substrates since they supply the degree of rigidity needed to support the laminate and offer a suitable face for bonding. The section "Substrates" states further that plywood may be used in some applications, but its dimensional movement is significantly less than high decorative laminate. This may result in potential panel warpage, stress cracking, and open seams. The section "Adhesive selector" states that resocinol resin adhesives may be used for bonding decorative laminate to particleboard when heat resistance is required. The section "Laminating principles" states that architectural applications usually require decorative laminate to be bonded to a substrate. Laminating decorative laminate to substrate material should be done according to the proven principles of fabrication. All components should have properties suitable for the end use of the finished product.

SUMMARY

Example embodiments provide an elevator car with a fire retarding wall and/or ceiling cover that is cheap, easy to install, and has an appealing appearance.

The elevator car comprises a floor and a ceiling as well as side walls connecting the floor and the ceiling. At least the inner surface of at least some of the side walls of the elevator car is covered with sheets of board. The board comprises fire retardant plywood having a front surface and an opposite back surface.

The sheet of board is characterized in that:

the fire retardant plywood comprises veneer sheets that have been separately impregnated with a fire retardant solution before bonding the veneer sheets together to form the plywood, the fire retardant plywood having a thickness in the range of 5 to 8 mm, the front surface of the fire retardant plywood is coated with a first material layer comprising a fire retardant laminate comprising a melamine impregnated decorative paper combined with a fire retardant phenolic treated kraft paper, the fire retardant laminate having a thickness in the range of 0.4 to 1 mm, the fire retardant laminate is attached to the fire retardant plywood with two-component glue based on phenol resorcinol and a formaldehyde hardener or melamine-formaldehyde two component glue, the back surface of the fire retardant plywood is coated with a second material layer having the same thickness and the same material properties as the laminate.

The board comprising the plywood coated with the first and the second material layers will have good fire retarding characteristics. The second material layer having the same thickness and the same material properties as the first material layer makes the board symmetric. This is important in order to ensure that the board remains straight also in exceptional environmental conditions. The first layer and the second layer should act in the same way during the temperature increase in a fire in order to eliminate curvature of the board.

Curvature of the board will have a negative impact on the fire characteristics of the board. There might develop bubbles on the surface of a curved board and these bubbles form a route for hot burning gases to propagate into the board and to form flaming droplets. The board must remain straight during fire in order to achieve a high fire class. It is also important that the laminate remains attached to the plywood during fire. The combination of fire retarding plywood and fire retarding laminate attached with heat resistant or fire retardant glue makes it possible to achieve a high fire class. The board can be rated at least in the fire class B-s2, d1 according to the European fire classification standard EN 13501-1.

The fire retarding plywood forms the supporting structure of the board. The thickness of the fire retarding plywood is in the range of 5 to 8 mm. Plywood of the thickness 6 or 8 mm could advantageously be used in the board. Plywood sheets having a standard width in the range of 1220 to 1250 mm or 1525 mm can e.g. be used in the board. Each veneer sheet in the fire retardant plywood has been separately impregnated with a fire retardant solution before bonding the veneer sheets together to form the plywood. The fire retardant plywood can be rated at least in the fire class B-s2, d1 according to the European fire classification standard EN 13501-1.

The first material layer comprising laminate at the front surface of the plywood and the second material layer at the back surface of the plywood stiffen the plywood and eliminate curving of the plywood. The laminate at the front surface also gives an appealing appearance to the board. The laminate should be as thin as possible in order to increase the thickness and the weight of the board as little as possible. The thickness of the fire retardant laminate is in the range of 0.4 to 1 mm. Laminate sheets having a standard width of 1300 1500 mm can e.g. be used to cover the plywood. The fire retardant laminate is formed of melamine impregnated decorative paper combined with fire retardant phenolic treated kraft paper. The fire retardant laminate can be rated at least in the fire class B-s2, d1 according to the European fire classification standard EN 13501-1.

The amount of heat resistant or fire retarding glue between the plywood and the laminate is in one embodiment 150 g/m$^2$. The glue between the fire retardant laminate and the fire retardant plywood could be heat resistant or fire retarding. Heat resistant glues are, however, the more preferable alternative. Heat resistant glues keep the laminate attached to the plywood during fire.

The heat produced during the fire seems to be problematic for glues. Glues which have fire retarding properties might not be able to keep the laminate attached to the plywood during fire. The glue between the fire retardant laminate to the fire retardant plywood is two-component glue based on phenol resorcinol and a formaldehyde hardener or melamine-formaldehyde two component glue. Some of the side walls or all of the side walls of the elevator car can 5 be covered with the board comprising plywood and laminate. The board could also be used in the ceiling of the elevator car. The plywood should, however, be thicker when the board is used in the ceiling compared to the plywood when the board is used in the side walls. The thickness of the plywood in the board used in the ceiling could be e.g. 15 mm or more. The increased thickness is due to the increased strength requirements in the ceiling compared to the wall. The ceiling must withstand the weight of a service person walking on the ceiling.

The sheets of board comprising the plywood and the laminate can be attached to the wall of the elevator car e.g. with aluminium lists running between the sheets of board. The board and the lists will thus form a modular construction which is easy and fast to install. The wall thus constructed will also be stiff enough. The board will also be rather light due to the limited thickness of the plywood. Also the laminate will be very light and suitable to form the interior surface of the elevator car. It is possible to achieve any desired appearance with the decorative paper in the laminate.

BRIEF DESCRIPTION OF THE DRAWINGS

The invention will in the following be described in greater detail by means of preferred embodiments with reference to the attached drawings, in which.

DETAILED DESCRIPTION OF EXAMPLE EMBODIMENTS

Figure 1:
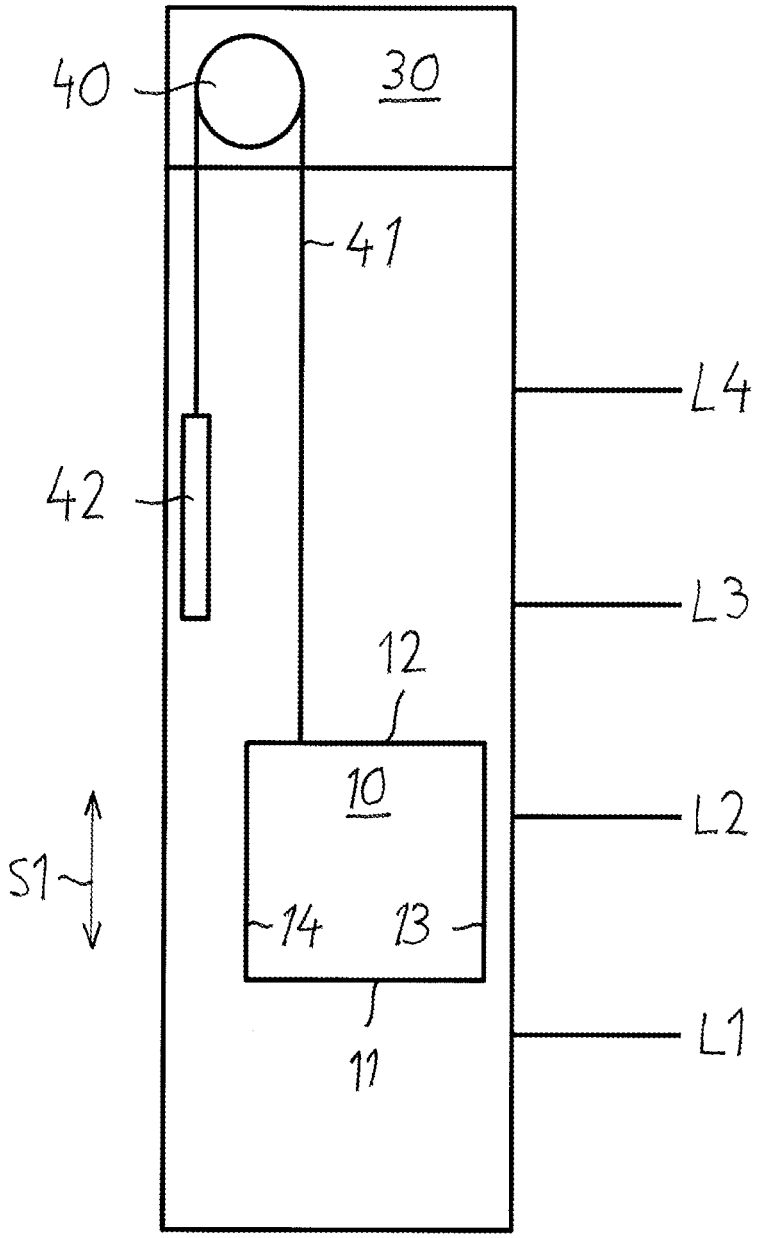
FIG. 1 shows a vertical cross section of an elevator according to example embodiments.

FIG. 1 shows a vertical cross section of an elevator. The elevator comprises a car 10, an elevator shaft, a machine room 30, lifting machinery 40, ropes 41, and a counter weight 42. The lifting machinery 40 moves the car 10 in a first direction S1 upwards and downwards in the vertically extending elevator shaft. The car 10 comprises a floor 11, a ceiling 12 and side walls 13, 14 connecting the floor 11 and the ceiling 12. The floor 11 and the ceiling 12 are horizontal and the side walls 13, 14 are vertical. The car 10 is carried by the ropes 41, which connect the car 10 to the counter weight 42. The car 10 is supported and guided with suitable means when moving upwards and downwards in the elevator shaft. The car 10 can be stopped at each landing L1 to L4 so that the floor 11 of the car 10 is at the same level as the floor of the landing L1 to L4. The elevator shaft can be formed so that the wall structure is formed of solid walls or so that the wall structure is formed of an open steel structure.

Figure 2:
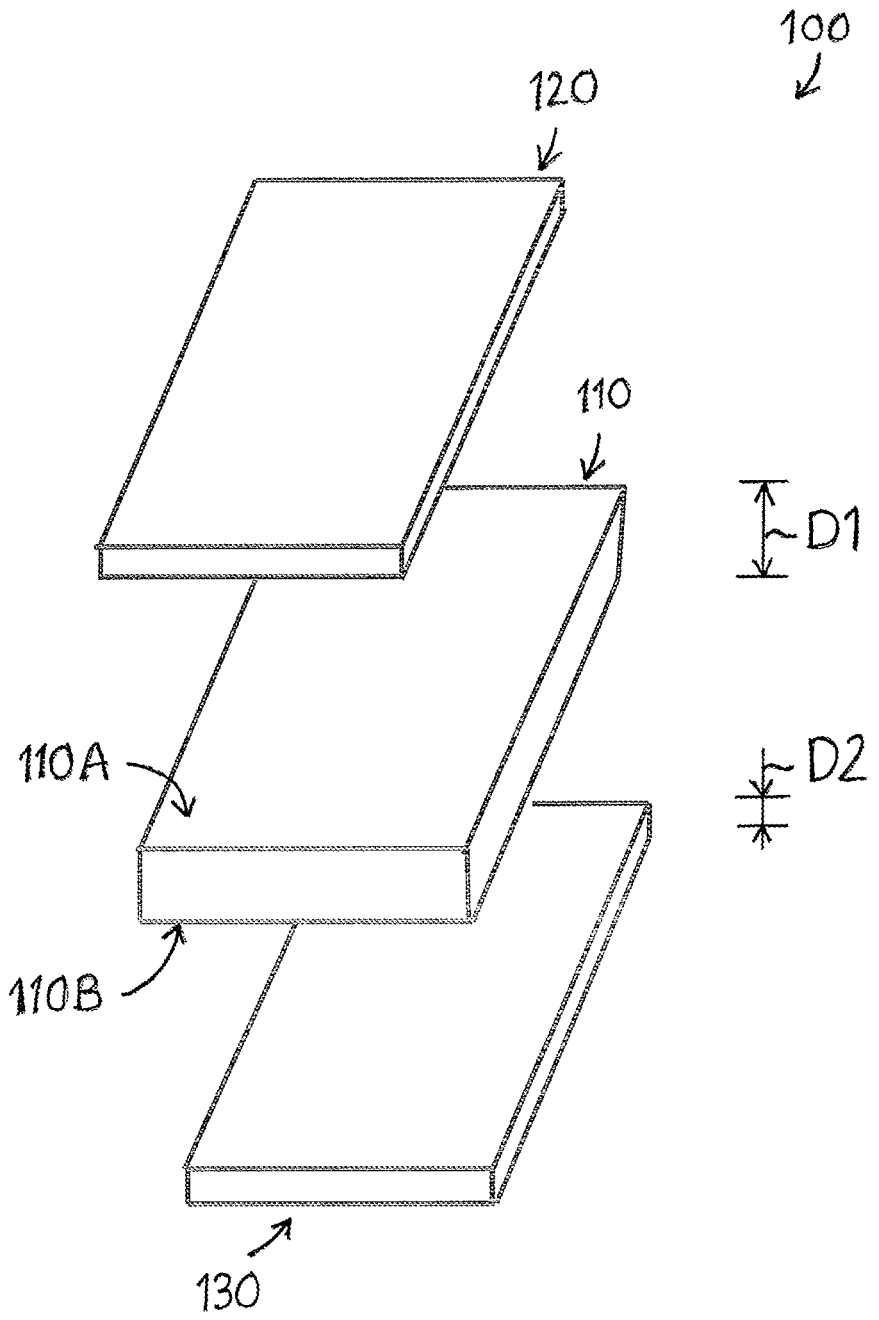
FIG. 2 shows an exploded view of a board to be used in an elevator car according to an example embodiment.

FIG. 2 shows an exploded view of a sheet of board to be used in the elevator car according to the invention. The sheet of board 100 comprises fire retardant plywood 110 having a front surface 110A and an opposite back surface 110B. The front surface 110A of the plywood 110 is the surface that will be facing towards the interior of the elevator car 10. The thickness D1 of the fire retardant plywood 110 is in the range of 5 to 8 mm. The front surface 110A of the fire retardant plywood 110 is coated with a first material layer 120 comprising a fire retardant laminate. The back surface 110B of the fire retardant plywood 110 is coated with a second material layer 130 having the same thickness and the same material properties as the fire retardant laminate. The thickness D2 of the fire retardant laminate 120 is in the range of 0.4 to 1 mm corresponding to the thickness of the second material layer 130. The fire retardant laminate 120 is fastened in a press with a heat resisting or fire retarding two-component glue based on phenol resorcinol and a formaldehyde hardener or melamine-formaldehyde two component glue to the front surface 110A of the fire retardant plywood 110. The second material layer 130 is fastened in a press with glue, advantageously with a heat resisting or fire retarding two-component glue based on phenol resorcinol and a formaldehyde hardener or melamine-formaldehyde two component glue to the back surface 110B of the fire retarding plywood 110. The fire retarding laminate 120 attached the front surface 110A of the plywood 110 will stiffen the plywood 110 and will further give a desirable appearance to the visible surface of the wall structure. The second material layer 130 attached to the back surface 110B of the plywood 110 will also stiffen the plywood 110. The thickness and the material properties of the second layer 130 should correspond to those of the laminate in order to achieve a symmetric structure of the board 100. The symmetric structure of the board 100 will keep the board 100 straight also in varying climate conditions. The laminate 120 at the front surface 110A of the plywood 110 and the second material layer 130 at the back surface 110B of the plywood 110 will expand and/or contract in the same way during varying climate conditions. The second material layer 130 could advantageously comprise the same laminate as the first material layer 120. The board 100 can be rated at least in fire class B-s2, d1 according to the European fire classification standard EN 13501-1.

Figure 3:
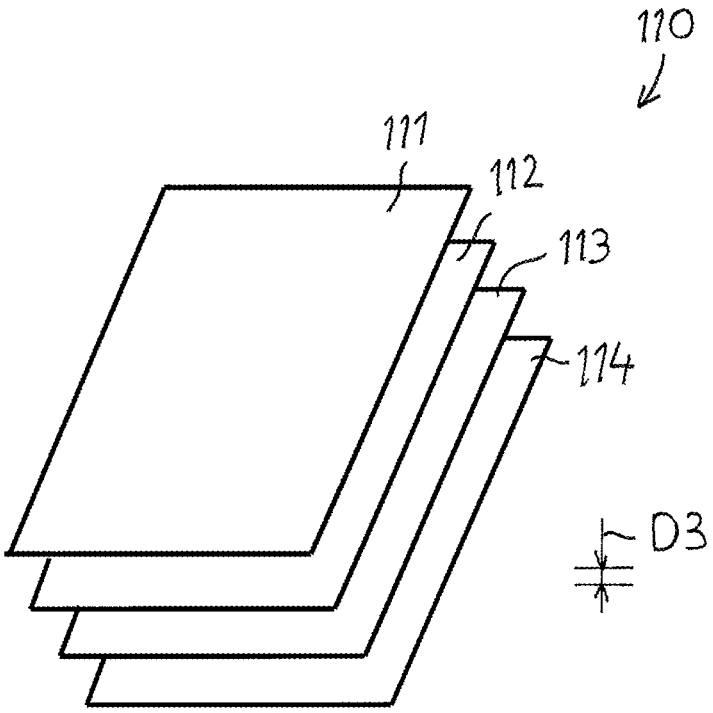
FIG. 3 shows an exploded view of the plywood used in the board in FIG. 2.

FIG. 3 shows an exploded view of the plywood used in the board in FIG. 2. The fire retardant plywood 110 comprises several veneer sheets 111, 112, 113, 114 which are combined together in a press. The thickness D3 of the veneer sheets 111, 112, 113, 114 is in the range of 1 to 2 mm. Heat resisting or fire retarding glue have been applied on both surfaces of each veneer sheet 111, 112, 113, 114 before they are combined in the press. Heat could be used in the press in order to intensify the bonding of the veneer sheets 111, 112, 113, 114. The veneer sheets 111, 112, 113, 114 are stacked so that the direction of the fibres run crosswise in every second veneer sheet 111, 112, 113, 114. Each veneer sheet 111, 112, 113, 114 in the fire retardant plywood 110 has advantageously been separately impregnated with a fire retardant solution before bonding the veneer sheets 111, 112, 113, 114 together to form the plywood 110. The fire retarding characteristics of the plywood 110 can be improved by impregnating each veneer sheet 111, 112, 113, 114 separately with a fire retarding solution. The veneer sheets 111, 112, 113, 114 can be impregnated with any suitable fire retarding solution. The fire retarding plywood 110 can be rated at least in fire class B-s2, d1 according to the European fire classification standard EN 13501-1.

Figure 4:
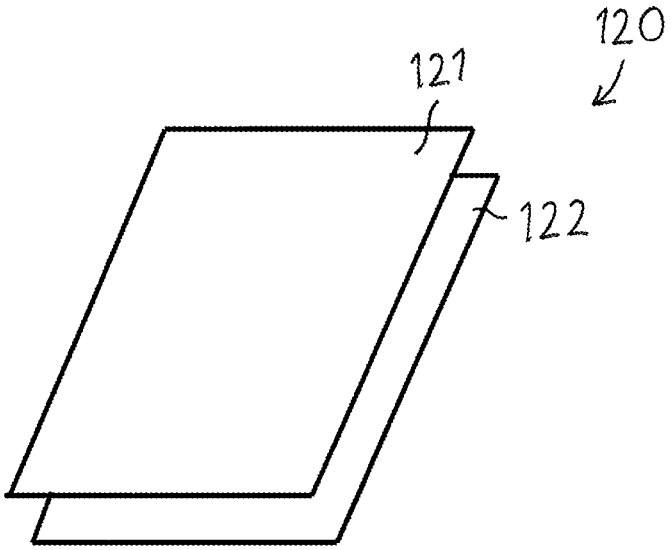
FIG. 4 shows an exploded view of the laminate used in the board in FIG. 2.

FIG. 4 shows an exploded view of the laminate used in the board in FIG. 2. The fire retardant laminate 120 comprises a melamine impregnated decorative paper 121 combined with a fire retardant phenolic treated kraft paper 122. The melamine impregnated decorative paper 121 and the fire retardant phenolic treated kraft paper have been attached together in a heated press at high pressure. The fire retarding laminate 120 can be rated at least in fire class B-s2, d1 according to the European fire classification standard EN 13501-1.

The board 100 comprising the plywood 110, the first material layer 120 and the second material layer 130 can be used at least in some of the side walls 13, 14 of the elevator car 10. The board 100 could also be used in the ceiling 12 of the elevator car 10. A thicker plywood 110 must, however, be used in the ceiling 12 due to the increases strength requirements in the ceiling compared to the wall.

The plywood 110 used in the board 100 can be any suitable plywood that can be made fire retarding by impregnating the veneer sheets 111, 112, 113, 114 in the plywood 110 with a suitable fire retardant solution.

The first material layer 120 could further be coated with a metal layer in the form of a thin metal sheet. Also the second material layer 130 could further be coated with a metal layer in the form of a thin metal sheet. The metal sheets on both outer surfaces of the board 100 would further improve the fire properties of the board. The metal sheets would be fastened with heat resistant glue to the board 100.

It will be obvious to a person skilled in the art that, as the technology advances, the inventive concept can be implemented in various ways. The invention and its embodiments are not limited to the examples described above but may vary within the scope of the claims.

The invention claimed is:

1. An elevator car, comprising:

a floor;

a ceiling; and side walls connecting the floor and the ceiling, wherein at least an inner surface of at least some of the side walls of the elevator car are covered with sheets of board including a fire retardant plywood having a front surface and an opposite back surface, the fire retardant plywood includes a plurality of veneer sheets, in which each veneer sheet has been separately impregnated with a fire retardant solution before bonding the plurality of veneer sheets together in a heated press with a heat resistant or a fire retardant glue applied to both sides of each of the plurality of veneer sheets to form the fire retardant plywood, the fire retardant plywood having a thickness in a range of 5 to 8 mm, the front surface of the fire retardant plywood is coated with a first material layer of a fire retardant laminate, the fire retardant laminate including a melamine impregnated decorative paper combined with a fire retardant phenolic treated kraft paper, the fire retardant laminate having a thickness in a range of 0.4 to 1 mm, said fire retardant laminate being attached with the heat resistant or the fire retardant glue to the fire retardant plywood and the back surface of the fire retardant plywood is coated with a second material layer having a same thickness and same material properties as the first material layer, and the heat resistant or the fire retardant glue is a two-component glue based on a phenol resorcinol and a formaldehyde hardener, or a melamine-formaldehyde.

2. The elevator car according to claim 1, wherein the second material layer comprises the same fire retardant laminate as the first material layer.

3. The elevator car according to claim 1, wherein the fire retardant laminate is fastened with the heat resistant or fire retardant glue to the fire retardant plywood.

4. The elevator car according to claim 1, wherein an amount of pressure of the heat resistant or fire retardant glue applied between the fire retardant plywood and the fire retardant laminate is 150 $g/m^2$.

5. The elevator car according to claim 1, wherein the fire retardant plywood is rated in at least fire class B-s2, d1 according to an European fire classification standard EN 13501-1.

6. The elevator car according to claim 1, wherein the fire retardant laminate is rated in at least fire class B-s2, d1 according to an European fire classification standard EN 13501-1.

7. The elevator car according to claim 1, wherein the sheet of board is rated in at least fire class B-s2, d1 according to an European fire classification standard EN 13501-1.

8. The elevator car according to claim 1, wherein the sheets of board are applied to the ceiling of the elevator car.

9. The elevator car according to claim 8, wherein the sheets of board used in the ceiling is thicker than the sheets of board used in the side walls.

10. The elevator car according to claim 1, wherein the first material layer of the fire retardant plywood is coated with a metal layer.

11. The elevator car according to claim 10, wherein the metal layer of the first material layer is fastened with a heat resistant glue to the sheets of board.

12. The elevator car according to claim 1, wherein the second material layer of the fire retardant plywood is coated with a metal layer.

13. The elevator car according to claim 12, wherein the metal layer of the second material layer is fastened with a heat resistant glue to the sheets of board.

* * * * *